US005460663A

United States Patent [19]

Hashimoto et al.

[11] Patent Number: 5,460,663

[45] Date of Patent: Oct. 24, 1995

[54] HIGH CORROSION RESISTANT AMORPHOUS ALLOYS

[75] Inventors: Koji Hashimoto; Jinhan Kim, both of Sendai; Hideaki Yoshioka, Kurobe; Hiroki Habazaki, Sendai; Asahi Kawashima, Sendai; Katsuhiko Asami, Sendai, all of Japan

[73] Assignee: YKK Corporation, Tokyo, Japan

[21] Appl. No.: 231,591

[22] Filed: Apr. 20, 1994

Related U.S. Application Data

[63] Continuation of Ser. No. 961,783, Oct. 15, 1992, abandoned.

[30] Foreign Application Priority Data

Oct. 16, 1991 [JP] Japan ..... 3-267542

[51] Int. Cl.[6] ..... C22C 45/00

[52] U.S. Cl. ..... 148/403; 420/425; 420/426; 420/427; 420/428

[58] Field of Search ..... 148/403, 304, 148/423, 422, 421, 442; 420/428, 580, 588, 425, 426, 427, 421, 422, 418, 423, 428

[56] References Cited

U.S. PATENT DOCUMENTS 4,338,145 7/1982 Yasujima et al. ..... 148/518

5,380,375 1/1995 Hashimoto et al. ..... 148/403

FOREIGN PATENT DOCUMENTS 62-33735 2/1987 Japan ..... 148/403

2-182897 7/1990 Japan .

*Primary Examiner*—John Sheehan

*Assistant Examiner*—Sikyin Ip

*Attorney, Agent, or Firm*—Flynn, Thiel, Boutell & Tanis

[57] ABSTRACT

Amorphous alloys having an extremely high corrosion resistance comprise Cr and at least one element selected from Ta and Nb, as essential components, and are spontaneously passive owing to the formation of stable protective films, even in very corrosive environments such as poorly oxidizing concentrated hydrochloric acid. The amorphous alloy may further include one or more elements appropriately selected from other alloying elements of Al, Ti, Zr, Fe, Co, Ni, Cu, Mo and W. The amorphous alloys have advantageous properties, such as very high corrosion resistance, high corrosion resistance at elevated temperatures and high wear resistance, and, therefore are useful in chemical plants or other industrial and domestic applications.

14 Claims, 1 Drawing Sheet

HIGH CORROSION RESISTANT AMORPHOUS ALLOYS

This application is a continuation of U.S. Ser. No. 07/961 783, filed Oct. 15, 1992, now abandoned.

BACKGROUND OF THE INVENTION

1. Field of the Invention

The present invention relates to novel amorphous alloys with advantageous properties, such as very high corrosion resistance, high corrosion resistance at elevated temperatures and high wear resistance, which are useful in chemical plants or other industrial and domestic applications.

2. Description of the Prior Art

Generally, alloys are crystalline in the solid state. However, an amorphous structure, which is similar to a liquid but does not have a crystalline structure, is formed from specific alloy compositions by preventing the formation of long-range ordering of atomic arrangement during solidification through, for example, rapid solidification from the liquid state, sputter deposition using specific targets, etc. The alloys thus obtained are called amorphous alloys. The amorphous alloys are generally composed of a homogeneous supersaturated solid solution and have a significantly higher strength as compared with ordinary practical metallic materials. Also, the amorphous alloys have an extremely high corrosion resistance and other various advantageous properties depending on their compositions.

The present inventors have developed various amorphous alloys with a high corrosion resistance which have not been obtained in crystalline alloys. These amorphous alloys are roughly classified into two types, one being metal-semimetal amorphous alloys and the other metal-metal alloys. The metal-semimetal alloys consist of iron family elements of Fe, Ni and Co with semimetal elements, such as P, C, B or Si, in amounts of about 10 to 25 atomic % in which the semimetals are required to form an amorphous phase. The corrosion resistance of the metal-semimetal alloys have been enhanced by adding Cr thereto. On the other hand, the metal-metal system alloys consist of elements of Groups VIII and 1b, such as Fe, Co, Ni, Cu, etc., and valve metals of Groups 1Va and Va, such as Ta, Nb, Zr, Ti, etc. In the latter alloys, their corrosion resistance is provided due to the presence of the valve metals constituting the amorphous alloys. Particularly, among them, amorphous alloys including Ta or Nb of the Group Va provide an extremely high corrosion resistance.

As mentioned above, amorphous alloys including chromium, which is effective in improving the corrosion resistance properties of the amorphous alloys, require semimetals for amorphization. Further, metal-metal amorphous alloys have been obtained only from elements belonging to different groups which are listed apart from each other in the Periodic Table. In these two types of amorphous alloys, if single-phase Cr alloys with Ta and/or Nb can be obtained, such alloys can be expected as ideal alloys having an extremely high corrosion resistance because these elements improve the corrosion resistance of the alloys of the above-mentioned two different systems.

The present inventors have previously developed novel amorphous alloys and made various extensive studies on the properties thereof. As a result, it was found that amorphous alloys consisting of metals having high melting points and metals having low melting points can be prepared by using a sputter deposition process which does not require any melting step during the alloying process. In such a manner, the inventors have succeeded in preparing amorphous alloys consisting of an element or elements selected from Ti, Zr, Nb, Ta, Mo, W, etc., which belong to Group 1Va, Va or VIa, and an element or elements selected from Cu, Al, etc., which belong to Group Ib or IIIb. Some of the alloys thus obtained were filed in Japanese Patent Applications 62-103296, 63-51567, 63-51568, and 63-260020. Among those Japanese Patent Applications, the first three applications correspond to U.S. Pat. Nos. 5,030,300 and 5,041,175 and the forth application corresponds to U.S. Pat. Nos. 5,076,865 and 5,123,980.

The present inventor's studies were further continued and attempts were made to prepare high corrosion resistance metal-metal amorphous alloys from elements belonging to neighboring groups in the Periodic Table. As a result, amorphous alloys consisting of Ti and/or Zr belonging to Group 1Va elements and Cr belonging to Group V1a elements were successfully prepared and filed in Japanese Patent Application No. 3-138575.

The inventors further continued their studies and investigated alloying conditions, etc. They succeeded in preparing amorphous alloys from a combination of Nb and/or Ta selected from the group Va elements and Cr selected from the Group V1a elements. These Groups are neighboring groups in the Periodic Table and the selected elements, i.e., Nb, Ta and Cr are most effective in enhancing the corrosion resistance. The present invention was achieved on the basis of such a finding.

SUMMARY OF THE PRESENT INVENTION

The present invention is therefore directed to providing amorphous alloys having an extremely high corrosion resistance and consisting of Cr, which is essential to achieve a high corrosion resistance in amorphous alloys consisting mainly of iron family elements, and at least one selected from Ta and Nb, which effectively act to obtain amorphous metal-metal system alloys having very high corrosion resistance properties, with or without addition of other various elements. Cr and Ta and Nb belong to neighboring groups, that is, Group IVa and Group V, respectively, in the Periodic Table.

The present invention consists of the following eight aspects:

1. A high corrosion resistant amorphous alloy consisting of 25 to 70 atomic % of at least one element selected from the group consisting of Ta and Nb, with the balance being substantially Cr.

2. A high corrosion resistant amorphous alloy consisting of 25 to 70 atomic % of at least one element selected from the group consisting of Ta and Nb, 45 atomic % or less Al, with the balance being substantially 30 atomic % or more Cr.

3. A high corrosion resistant amorphous alloy consisting of 25 to 70 atomic % in total of elements in two groups, i.e., at least one element selected from the group consisting of Ta and Nb and less than 70 atomic % of at least one element selected from the group consisting of Ti and Zr, with the balance being substantially Cr.

4. A high corrosion resistant amorphous alloy consisting of 25 to 70 atomic % in total of elements in two groups, i.e., at least one element selected from the group consisting of Ta and Nb and less than 70 atomic % of at least one element selected from the group consisting of Ti and Zr, and 45 atomic % or less Al, with the balance being substantially 30 atomic % or more Cr.

5. A high corrosion resistant amorphous alloy consisting of 25 to 70 atomic % in total of elements in two groups, i.e., 20 atomic % or more of at least one element selected from the group consisting of Ta and Nb and 20 atomic % or less of at least one element selected from the group consisting of Fe, Co, Ni, Cu, Mo and W, with the balance being substantially Cr.

6. A high corrosion resistant amorphous alloy consisting of 25 to 70 atomic % in total of elements in three groups, i.e., at least one element selected from the group consisting of Ta and Nb, less than 70 atomic % of at least one element selected from the group consisting of Ti and Zr and 20 atomic % or less of at least one element selected from the group consisting of Fe, Co, Ni, Cu, Mo and W, with the balance being substantially Cr.

7. A high corrosion resistant amorphous alloy consisting of 25 to 70 atomic % in total of elements in two groups, i.e., 20 atomic % or more of at least one element selected from the group consisting of Ta and Nb and 20 atomic % or less of at least one element selected from the group consisting of Fe, Co, Ni, Cu, Mo and W and 45 atomic % or less Al, with the balance being substantially 30 atomic % or more Cr.

8. A high corrosion resistant amorphous alloy consisting of 25 to 70 atomic % in total of elements in three groups, i.e., at least one element selected from the group consisting of Ta and Nb, less than 70 atomic % of at least one element selected from the group consisting of Ti and Zr and 20 atomic % or less of at least one element selected from the group consisting of Fe, Co, Ni, Cu, Mo and W, and 45 atomic % or less Al, with the balance being substantially 30 atomic % or more Cr.

BRIEF DESCRIPTION OF THE DRAWINGS

FIG. I is a perspective view showing a sputtering apparatus for preparing amorphous alloys of the present invention.

DETAILED DESCRIPTION OF THE PREFERRED EMBODIMENTS

The present invention provides the extremely high corrosion resistance amorphous alloys described above. Table I shows the constituent elements and contents of the alloys according to the present invention.

TABLE 1

| | Alloy Composition (atomic %) of the Present Invention | | | | |
|---|---|---|---|---|---|
| | Ta, Nb (*1) | Ti, Zr (*2) | Fe, Co, Ni, Cu, Mo, W (*3) | Al | Cr |
| 1 | 25–70 | | | | Bal.(*4) |
| 2 | 25–70 | | | 45 or less | 30 or more(*4) |
| 3 | 25–70(*5) | less than 70 | | | Bal.(*4) |
| 4 | 25–70(*5) | less than 70 | | 45 or less | 30 or more(*4) |
| 5 | 20 or more[(25–70)(*6)] | | 20 or less | | Bal.(*4) |
| 6 | 25–70(*7) | less than 70 | 20 or less | | Bal.(*4) |
| 7 | 20 or more[(25–70)(*6)] | | 20 or less | 45 or less | 30 or more(*4) |
| 8 | 25–70(*7) | less than 70 | 20 or less, | 45 or less | 30 or more(*4) |

*1 At least one element selected from the group of Ta and Nb
*2 At least one element selected from the group of Ti and Zr
*3 At least one element selected from the group Fe, Co, Ni, Cu, Mo and W
*4 Substantial balance
*5 The sum of two groups consisting of at least one element selected from the group of Ta and Nb and than 70 atomic % of at least one element selected from the group of Ti and Zr
*6 The sum of two groups consisting of at least 20 atomic % of at least one element selected from the group of Ta and Nb and at most 20 atomic % of at least one element selected from the group of Fe, Co, Ni, Cu, Mo and W
*7 The sum of three groups consisting of at least one element selected from the group of Ta and Nb, 20 atomic % or less of at least one element selected from the group of Fe, Co, Ni, Cu, Mo and W and less than 70 atomic % of at least one element selected from the group of Ti and Zr.

Sputtering is one process for preparing amorphous alloys. In detail, amorphous alloys are prepared by sputtering using a target which is the same in its average composition as the amorphous alloys to be prepared but composed of multiple (not single) crystalline phases. The used target may be prepared by sintering or melting. Alternatively, the target may be composed of a metal sheet of the main element of the alloy to be prepared and other alloying elements placed on or embedded into the metal sheet.

Figure 1:
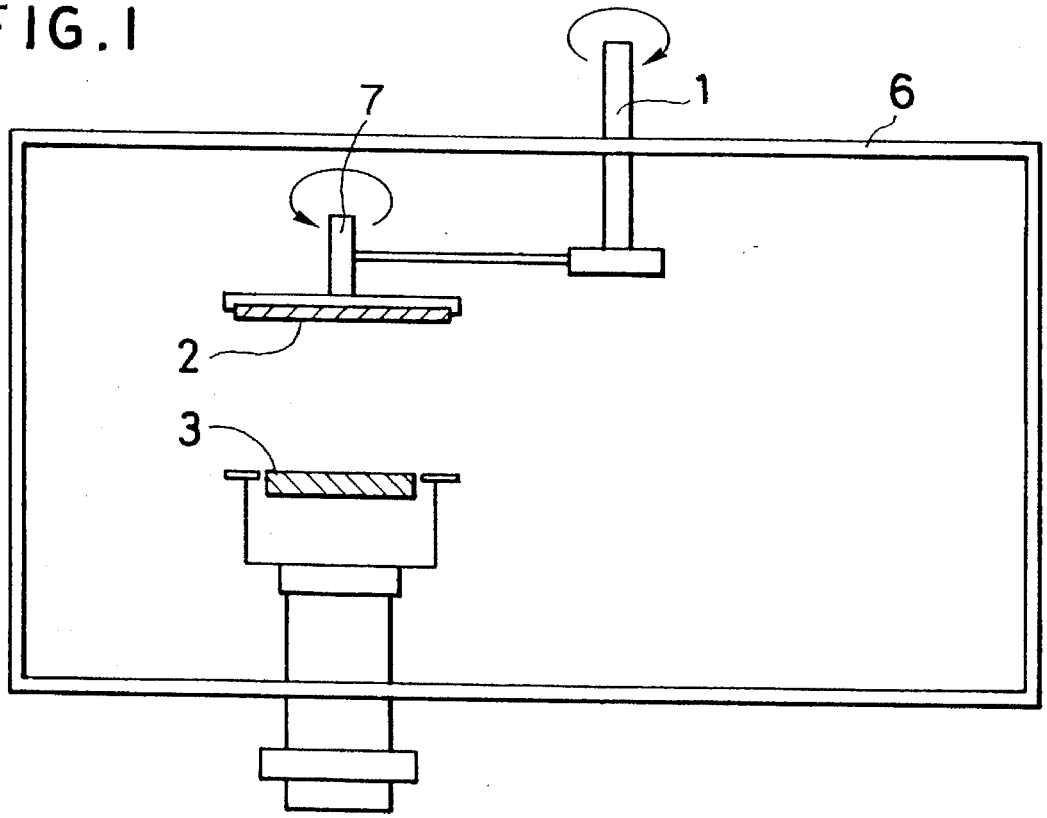
Figure 2:
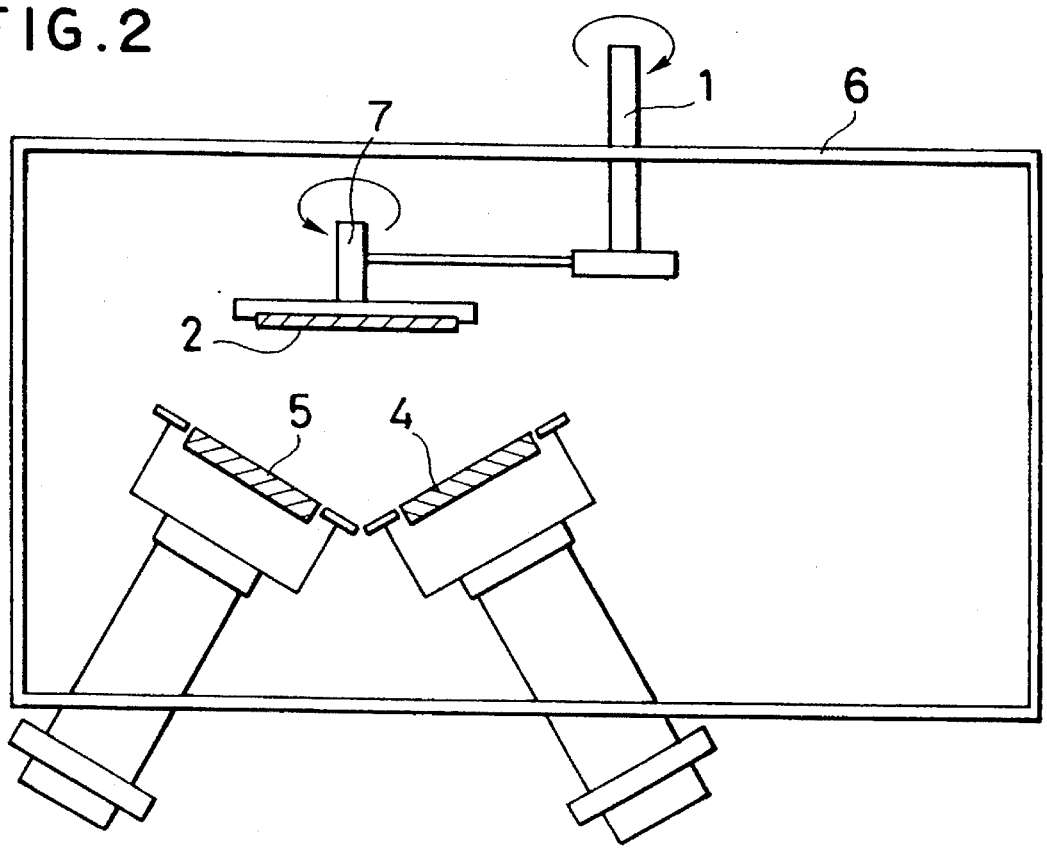
FIG. 2 is a perspective view showing another sputtering apparatus for preparing amorphous alloys of the present invention.

In the present invention, the aforestated preparation process was used or suitably modified as set forth below. It is not easy to prepare a Cr—Ta or Cr—Nb alloy target by melting or the like. However, amorphous alloys of Cr—Ta, Cr—Nb or Cr—Ta—Nb with high corrosion resistance can be obtained by sputtering using a target consisting of a Cr sheet and Ta and/or Nb placed on or embedded into the Cr sheet. In this process, in order to avoid local compositional heterogeneity of the resultant amorphous alloys, it is desirable to cause plural substrates 2 to turn round on their axes 7 in addition to revolution of the substrates 2 around a central axis 1 in a sputtering chamber 6, as shown in FIG. 1. Alternatively, in order to change widely the composition of the amorphous alloy formed, sputtering may be carried out as shown in FIG. 2. For instance, a target 4 is constituted of a Cr sheet and Ta and/or Nb embedded into the Cr sheet and another target 5 is constituted of Ta, Nb or Cr. These two targets 4 and 5 are installed obliquely in the sputtering chamber 6, in such a way that the substrate 2 is placed near the intersection of normals of the centers of the targets 4 and 5. The two targets 4 and 5 are simultaneously operated by two power sources under controlled conditions. In this manner, the contents of alloying elements in the resultant amorphous alloys can be widely changed. Further, when different various targets, for example, those prepared by embedding at least one selected from among Ti, Zr, Fe, Co, Ni, Mo, W and Al together with Nb and/or Ta into Cr are appropriately combined with the foregoing processes, there can be formed various amorphous alloys with an extremely high corrosion resistance. As examples of such alloys, there may be mentioned Cr—Ta, Cr—Nb, Cr—Ta—Nb, Cr—Ta—Al, Cr—Nb—Al, Cr—Ta—Nb—Al, Cr—Ta—Ti, Cr—Ta—Zr, Cr—Nb—Ti, Cr—Nb—Zr, Cr—Ta—Nb—Ti, Cr—Ta—Nb—Zr, Cr—Ta—Nb—Ti—Zr, Cr—Ta—Ti—Al, Cr—Ta—Zr—Al, Cr—Nb—Ti—Al, Cr—Nb—Zr—Al, Cr—Ta—Nb—Ti—Al, Cr—Ta—Nb—Zr—Al, Cr—Ta—Nb—Ti—Zr—Al, Cr—Ta—Fe, Cr—Ta—Co, Cr—Ta—Ni, Cr—Ta—Cu, Cr—Ta—Mo, Cr—Ta—W, Cr—Nb—Fe, Cr— Nb—Co, Cr—Nb—Ni, Cr—Nb—Cu, Cr—Nb—Mo, Cr—Nb—W, Cr—Ta— Nb—Ti—Zr—Fe—Co—Ni—Cu—Mo—W—Al. Particularly, when two targets are used, revolution of the substrate 2 around the central axis 1 and rotation of the substrate 2 itself on its axis 7 are both needed to prepare homogeneous amorphous alloys.

The alloys having the compositions of the present invention prepared by sputtering are single phase amorphous alloys in which the above-mentioned alloying elements are dissolved to form a uniform solid solution. The uniform solid solution amorphous alloys of the present invention can form an extremely uniform and highly corrosion-resistant protective film thereon. Metallic materials are easily dissolved in a poorly oxidizing and very corrosive environment, such as hydrochloric acid. Therefore, the metallic materials intended to be used in such an environment are required to have an ability to form a stable protective film and this requirement can be achieved by preparing alloys containing effective elements as much as necessary. However, when various alloying elements in large quantities are added to a crystalline metal, the resultant alloy has a chemically heterogeneous multiphase structure, with each phase having different chemical properties, and a uniform protective film ensuring a high corrosion resistance cannot be formed. Therefore, a satisfactory corrosion resistance cannot be achieved. Further, the chemical heterogeneity is rather detrimental to corrosion resistance.

On the contrary, the amorphous alloys of the present invention are composed of a uniform solid solution and uniformly contain effective elements as much as required to uniformly form a stable protective film. Owing to the formation of such a uniform protective film, the amorphous alloys of this invention exhibit a sufficiently high corrosion resistance. More specifically, in order to withstand a severely corrosive environment, metallic materials are required to have a high protective-film forming ability so as to uniformly form a stable protective film on the materials even in nonoxidizing environments. Such a requirement can be satisfied by the alloy composition of the present invention. Further, the amorphous alloy structure of the present invention makes it possible to prepare alloys having complex compositions in a single-phase solid solution state and also permits the formation of a uniform protective film.

A description will be next made about the reasons for the limitations of the alloying elements and compositions of the present invention.

Cr is able to form an amorphous structure when it coexist with at least one element selected from the group of Ta and Nb and needs one or two of Ta and Nb in an amount of 25 to 70 atomic % to form the intended amorphous structure by sputtering. Therefore, the alloy set forth in claim 1 should contain 25 to 70 atomic % of one or two of Ta and Nb. In this alloy, Ta and Nb may be partially replaced with one or two of Ti and Zr. However, in order to ensure a very high corrosion resistance, at least one element of Nb and Ta should be contained in the alloy. In claims 3 and 4, the elements of the two groups should be contained in the range of 25 to 70 atomic % in their total for the formation of the amorphous structure.

Al is an element which forms an amorphous structure in combination with Ta, Nb, Zr and/or Ti. Therefore, Al can be partially substituted for Cr and provides an improved resistance to oxidation at high temperatures. However, in order to obtain the intended very high corrosion resistance, Cr should be present in an content of 30 atomic % or more and the substitution of Al for Cr is not allowed to exceed 45 atomic %. This is the reason why the contents of Al and Cr are limited to not more than 45 atomic % and not less than 30 atomic %, respectively, in claims 2, 4, 7 and 8.

Further, although, in the formation of the amorphous alloys of the present invention, Ta, Nb, Ti and Zr can be partially replaced by one or more elements of Fe, Co, Ni, Cu, Mo and W, this replacement should be limited to 20 atomic % or less in the total of the foregoing replacement elements of Fe, Co, Ni, Cu, Mo and W for formation of the amorphous structure and attainment of the intended very high corrosion resistance. For this reason, at least one element selected from the group consisting of Fe, Co, Ni, Cu, Mo and W is limited to 20 atomic % or less in their total in claims 5 to 8. Further, in the alloys including one or two elements selected from the group consisting of Ta and Nb and at least one element selected from the group consisting of Fe, Co, Ni, Cu, Mo and W as set forth in claim 7, one or two of Ta and Nb should be contained in their total amount of 20 atomic % or more for the intended very high corrosion resistance, although Cr is contained in an amount of 30 atomic % or more.

The present invention will be further described by the following examples.

EXAMPLE 1

Targets were prepared by placing 4 to 9 Ta discs of 20 mm in diameter and 1 mm thick on a Cr disc of 100 mm in diameter and 6 mm thick in such a manner that the centers of the Ta discs were arranged on a concentric circle of 29 mm in radius from the center of the Cr disc. The targets thus prepared were used in the sputtering apparatus shown in FIG. 1. Sputter deposition was carried out onto substrates of Al and glass which were rotated about their axes 7 and also orbited about the central axis 1,at a power of about 400 W. During the sputter deposition, an Ar gas stream flow rate of 5 ml/min and a vacuum of $2\times10^{-4}$ Torr was maintained.

It was confirmed by X-ray diffraction analysis that the resultant alloys were all amorphous. Further, electron problem microanalysis showed that the amorphous alloys consisted of Cr-26 atomic % Ta, Cr-33 atomic % Ta, Cr-45 atomic % Ta, Cr-52 atomic % Ta, Cr-64 atomic % Ta and Cr-69 atomic % Ta.

These alloys were spontaneously passive in 12 N HCl at 30° C. and any loss due to corrosion could not be detected by microbalance even after immersion for a period of one month.

EXAMPLE 2

A Cr disc and an Nb disc, both being 100 mm in diameter and 6 mm thick, were installed as targets in the apparatus shown in FIG. 2. Sputter deposition was carried out onto substrates of Al and glass which were rotated about their axes 7 and also orbited about the central axis 1 of the apparatus, at a power of about 400 W. During the sputter deposition, an Ar gas stream flow rate of 5 ml/min and a vacuum of $1\times10^{-4}$–$4\times10^{-4}$ Torr was maintained.

It was confirmed by X-ray diffraction analysis that the resultant alloy was amorphous. Further, electron probe microanalysis showed that the amorphous alloy was a Cr-43 Nb alloy.

This alloy was spontaneously passive in 12N HCl at 30° C. and showed a small average corrosion rate of 0.5 mm/year calculated from the corrosion loss of one-month immersion in the 12N HCl. Consequently, the amorphous alloy was found to be highly corrosion-resistant.

EXAMPLE 3

Targets were prepared by placing Ta discs and other various metal or alloy discs, each having a diameter of 20 mm and a thickness of 1 mm, on a Cr disc of 100 mm in diameter and 6 mm thick in such a manner that the center of the Ta discs or other discs were arranged on a concentric circle of 29 mm in radius from the center of the Cr disc. The targets were used in the sputtering apparatus shown in FIG. 1. Sputter deposition was carried out onto substrates of Al and glass which were rotated about their axes 7 and also orbited about the central axis 1 of the apparatus, at a power of about 400 W. During the sputter deposition, an Ar gas stream was flowed at a rate of 5 ml/min and a vacuum of $2\times10^{-4}$ Torr was maintained.

It was confirmed by X-ray diffraction analysis that the resultant alloys were all amorphous. The compositions of these amorphous alloys obtained by electron probe microanalysis are shown in Table 2. These alloys were spontaneously passive in 12N HCl at 30° C. and were found to be highly corrosion-resistant.

TABLE 2

Corrosion rates of amorphous alloys measured in 12 N HCl at 30° C.

| Alloy (at. %) | Corrosion Rates mm/year |
|---|---|
| Cr-25Nb | 1.00 |
| Cr-29Nb | 0.85 |
| Cr-34Nb | 0.50 |
| Cr-43Nb | 0.29 |
| Cr-47Nb | 0.23 |
| Cr-57Nb | 0.17 |
| Cr-63Nb | 0.13 |
| Cr-69Nb | 0.13 |
| Cr-5Ta-21Nb | 0.002 |
| W-43Ta-26Nb | 0.001 or less |
| Cr-44Al-30Ta | 0.001 or less |
| Cr-20Al-50Nb | 0.24 |
| Cr-5Ta-60Ti | 0.007 |
| Cr-25Nb-43Zr | 0.9 |
| Cr-15Ta-15Ti-25Al | 0.01 |
| Cr-32Nb-10Zr-10Al | 0.8 |
| Cr-33Ta-6Fe | 0.001 or less |
| Cr-51Nb-17Co | 0.22 |
| Cr-36Ta-18Ni | 0.001 or less |
| Cr-55Ta-11Cu | 0.001 or less |
| Cr-48Nb-17Mo | 0.20 |

TABLE 2-continued

Corrosion rates of amorphous alloys measured in 12 N HCl at 30° C.

| Alloy (at. %) | Corrosion Rates mm/year |
|---|---|
| Cr-45Ta-19W | 0.001 or less |
| Cr-21Ta-9Mo-8W | 0.001 or less |
| Cr45Nb-17Ti-7Mo | 0.15 |
| Cr-17Ta-6Nb-9Ti-7Zr-4Mo-3W | 0.001 or less |
| Cr-20Ta-25Nb-2Ti-3Zr-2Fe-1Co-3Ni-7Mo-6W | 0.001 or less |
| Cr-29Ta-5Fe-35Al | 0.001 or less |
| Cr-48Nb-14Co-20Al | 0.24 |
| Cr-34Ta-17Ni-31Al | 0.001 or less |
| Cr-53Ta-10Cu-25Al | 0.001 or less |
| Cr-46Nb-16Mo-18Al | 0.27 |
| Cr-42Ta-15W-40Al | 0.001 or less |
| Cr-19Ta-8Mo-7W-27Al | 0.023 |
| Cr-45Nb-16Ti-7Mo-15Al | 0.24 |
| Cr-7Ta-6Nb-8Ti-7Zr-4Mo-3W-12Al | 0.023 |
| Cr-20Ta-15Nb-2Ti-3Zr-2Fe-1Co-3Ni-7Mo-6W-5Al | 0.001 or less |

As mentioned above in detail, the amorphous alloy of the present invention are amorphous alloys including Cr and at least one element selected from the group consisting of Ta and Nb as essential elements and the amorphous alloys can be easily prepared by sputtering. The amorphous alloys of the present invention have an extremely high corrosion resistance by spontaneous passivation owing to the formation of stable protective films even in very corrosive environments such as poorly oxidizing concentrated hydrochloric acid.

What is claimed is:

1. A highly corrosion-resistant single-phase amorphous alloy consisting of 25 to 70 atomic % of Ta and Nb or Nb alone, Al in an amount at lease 5 atomic % but not exceeding 45 atomic %, with the balance being Cr.

2. A highly corrosion-resistant single-phase amorphous alloy consisting of 25 to 70 atomic % of at least one element selected from the group consisting of Ta and Nb, Al in an amount at least 5 atomic % but not exceeding 45 atomic % with the balance being 30 atomic % or more Cr.

3. A highly corrosion-resistant single-phase amorphous alloy consisting of 25 to 70 atomic % in total of at least one element selected from the group consisting of Ta and Nb, Al in an amount at least 5 atomic % but not exceeding 45 atomic %, at least one element selected from the group consisting of Ti and Zr in an amount greater than 0 atomic % but less than 70 atomic %, with the balance being Cr.

4. A highly corrosion-resistant single-phase amorphous alloy consisting of 25 to 70 atomic % in total of at least one element selected from the group consisting of Ta and Nb, at least one element selected from the group consisting of Ti and Zr in an amount greater than 0 atomic % but less than 70 atomic %, Al in an amount at least 5 atomic % but not exceeding 45 atomic %, with the balance being 30 atomic % or more Cr.

5. A highly corrosion-resistant single-phase amorphous alloy consisting of 25 to 70 atomic % in total of 20 atomic % or more of at least one element selected from the group consisting of Ta and Nb and at least one element selected from the group consisting of Fe, Co, Cu, Mo and W in an amount greater than 0 atomic % but not exceeding 20 atomic %, Al in an amount at least 5 atomic % but not exceeding 45 atomic %, with the balance being Cr.

6. A highly corrosion-resistant single-phase amorphous alloy consisting of 25 to 70 atomic % in total of at least one element selected from the group consisting of Ta and Nb, at least one element selected from the group consisting of Ti and Zr in an amount greater than 0 atomic % but less than 70 atomic % and at least one element selected from the group consisting of Fe, Co, Cu, Mo and W in an amount greater than 0 atomic % but not exceeding 20 atomic %, Al in an amount at least 5 atomic % but not exceeding 45 atomic %, with the balance being Cr.

7. A highly corrosion-resistant single-phase amorphous alloy consisting of 25 to 70 atomic % in total of 20 atomic % or more of at least one element selected from the group consisting of Ta and Nb, at least one element selected from the group consisting of Fe, Co, Ni, Cu, Mo and W in an amount greater than 0 atomic % but not exceeding 20 atomic %, and Al in an amount at least 5 atomic % but not exceeding 45 atomic %, with the balance being substantially 30 atomic % or more Cr.

8. A highly corrosion-resistant single-phase amorphous alloy consisting of 25 to 70 atomic % in total of at least one element selected from the group consisting of Ta and Nb, at least one element selected from the group consisting of Ti and Zr in an amount greater than 0 atomic % but less than 70 atomic %, at least one element selected from the group consisting of Fe, Co, Ni, Cu, Mo and W in an amount greater than 0 atomic % but not exceeding 20 atomic %, and Al in an amount at least 5 atomic % but not exceeding 45 atomic %, with the balance being 30 atomic % or more Cr.

9. The alloy of claim 2, wherein said alloy contains Nb.

10. The alloy of claim 2, wherein said alloy contains Ta and Nb.

11. The alloy of claim 3, wherein said alloy contains Nb.

12. The alloy of claim 3, wherein said alloy contains Ta and Nb.

13. The alloy of claim 4, wherein said alloy contains Nb.

14. The alloy of claim 4, wherein said alloy contains Ta and Nb.

* * * * *

UNITED STATES PATENT AND TRADEMARK OFFICE

CERTIFICATE OF CORRECTION

PATENT NO. : 5,460,663

DATED : October 24, 1995

INVENTOR(S) : Koji HASHIMOTO, et al

It is certified that error appears in the above-indentified patent and that said Letters Patent is hereby corrected as shown below:

Column 8, line 35; change "lease" to ---least---.

Signed and Sealed this

Fourteenth Day of May, 1996

*Attest:*

Bruce Lehman

BRUCE LEHMAN

*Attesting Officer*

*Commissioner of Patents and Trademarks*